US011492167B2

(12) United States Patent
Stephan et al.

(10) Patent No.: US 11,492,167 B2
(45) Date of Patent: Nov. 8, 2022

(54) METHOD OF PACKAGING FOR SOLAR MOUNTING ATTACHMENTS

(71) Applicant: PEGASUS SOLAR, INC., Richmond, CA (US)

(72) Inventors: Erich Kai Stephan, Richmond, CA (US); Glenn Harris, Sausalito, CA (US); Peter Wilke, Richmond, CA (US); Nick Wenzel, Richmond, CA (US)

(73) Assignee: PEGASUS SOLAR, INC., Richmond, CA (US)

( * ) Notice: Subject to any disclaimer, the term of this patent is extended or adjusted under 35 U.S.C. 154(b) by 330 days.

(21) Appl. No.: 16/801,040

(22) Filed: Feb. 25, 2020

(65) Prior Publication Data

US 2020/0270010 A1 Aug. 27, 2020

Related U.S. Application Data

(60) Provisional application No. 62/811,069, filed on Feb. 27, 2019.

(51) Int. Cl.
*B65D 1/24* (2006.01)

(52) U.S. Cl.
CPC ..... *B65D 1/24* (2013.01); *B65D 2501/24* (2013.01)

(58) Field of Classification Search
CPC .. B65D 71/246; B65D 71/24; B65D 71/0022; B65D 5/48048; B65D 5/48042; B65D 5/48036; B65D 5/48014; B65D 5/48012; B65D 5/48006; B65D 5/46184; B65D 5/48; B65D 5/46064; B65D 1/24; B65D 2501/24; B65D 5/48026; B65B 61/207
See application file for complete search history.

(56) References Cited

U.S. PATENT DOCUMENTS

RE23,597 E * 12/1952 Bergstein ..... B65D 5/4802 229/120.04
9,120,593 B2 * 9/2015 Mena ..... B65D 5/48024
2007/0002518 A1 * 1/2007 Wilk ..... H01G 9/155 361/272
2009/0001084 A1 * 1/2009 Wang ..... B65D 5/48048 220/552
2009/0084835 A1 * 4/2009 Tibbels ..... B65D 5/48014 229/120.08
2009/0101538 A1 * 4/2009 Chen ..... B65D 5/5035 206/386
2009/0223857 A1 * 9/2009 Bowman ..... B65D 5/48042 493/162
2009/0301913 A1 * 12/2009 Scaletta ..... B25H 3/02 220/630

(Continued)

*Primary Examiner* — Kareen K Thomas
(74) *Attorney, Agent, or Firm* — Polsinelli LLP

(57) ABSTRACT

A method for packaging solar mounting attachments by forming a package box having a first end and a second end, sealing the first end of the package box, placing attachment brackets into compartments defined by dividers in the package box, placing a container of fasteners onto at least one of the attachment brackets, and placing flashings onto at least one other attachment bracket. The flashings, the container of fasteners, and attachment brackets may be removed from the package box from the second end in the order of flashings, the container of fasteners, and attachment brackets.

3 Claims, 9 Drawing Sheets

(56) References Cited

U.S. PATENT DOCUMENTS

| | | | | |
|---|---|---|---|---|
| 2009/0321298 | A1* | 12/2009 | Sturm | B65D 5/5425<br>128/200.26 |
| 2010/0084458 | A1* | 4/2010 | Corso | B65D 5/6652<br>53/473 |
| 2015/0283036 | A1* | 10/2015 | Aggarwal | A61J 7/049<br>206/534 |

* cited by examiner

METHOD OF PACKAGING FOR SOLAR MOUNTING ATTACHMENTS

CROSS-REFERENCE TO RELATED APPLICATION

This application claims the benefit of U.S. Provisional Patent Application No. 62/811,069, entitled "METHOD OF PACKAGING FOR SOLAR MOUNTING ATTACHMENTS," filed on Feb. 27, 2019, the contents of which are incorporated herein by reference in its entirety.

BACKGROUND

Solar mounting attachments are becoming increasingly simplified, consisting of just a few parts. However, current systems for packaging this equipment is complex, inefficient, wasteful, and fail to consider how the parts will be used.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

In one embodiment of the present invention, the structural solar mounting attachment may consist of several components, including a flashing, attachment bracket, one or more roof attachment fasteners, and sealing washer. The method to unpack the solar mounting attachment package box mimics the method used to install the solar mounting attachment on the roof. For example, the unpacking may follow a method as follows; first, an exterior packaging box is opened; second, a singular or stack of multiple flashings is removed from the box; third, one or more containers, such as an envelope, bag, or small box containing fasteners may be removed from the box; fourth, multiple attachment brackets may be removed from the box.

Figure 1A:
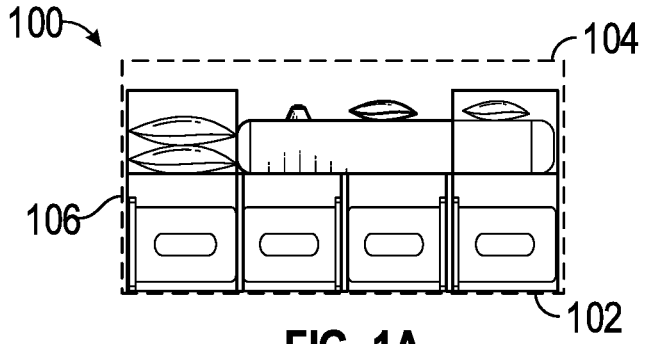
FIG. 1A illustrates an x-ray side view of a solar mounting attachment package box.
Figure 1B:
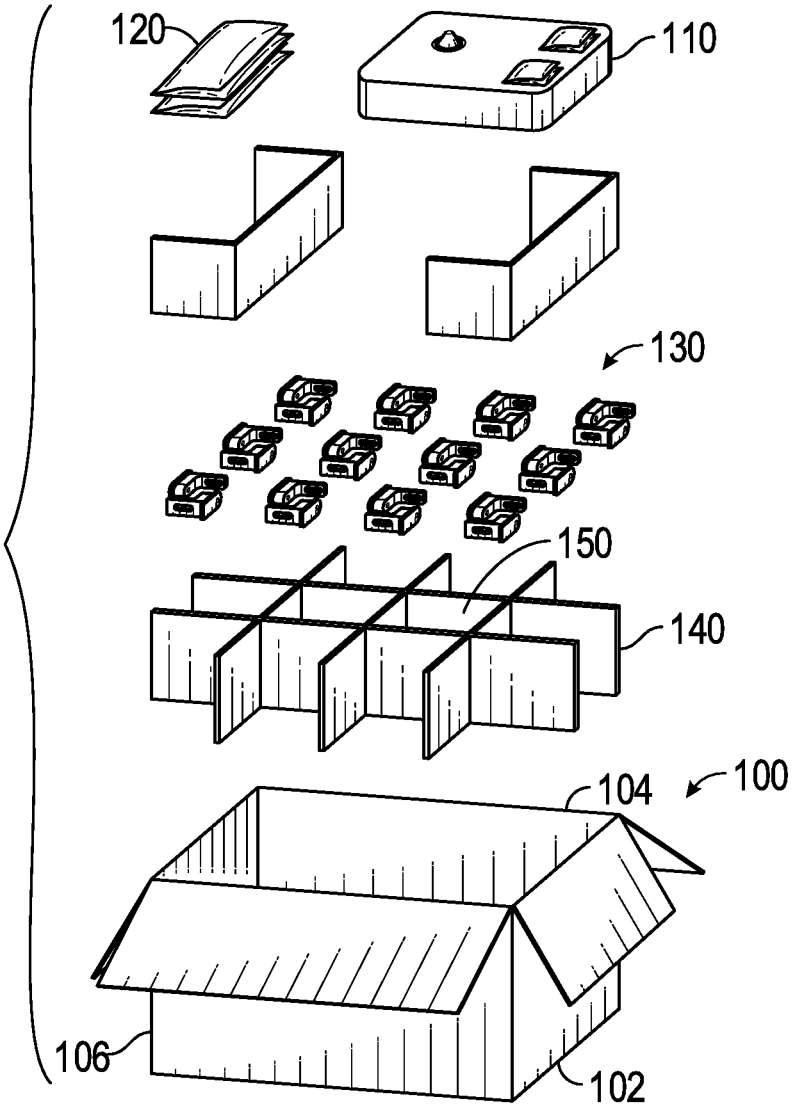
FIG. 1B illustrates an exploded view of the solar mounting attachment package box.

FIGS. 1A and 1B depict a package box 100 having a first end 102, a second end 104, and a sidewall 106. One of ordinary skill in the art would understand that the first end 102 and the second end 104 are interchangeable and defined for clarity and discussion purposes only. The package box 100 is used to contain all the materials necessary to secure a structural solar mounting attachment to a roof surface. More specifically, the package box 100 contains at least one flashing 110, at least one container 120 of fasteners, and at least one attachment bracket 130. Furthermore, the package box 100 may have dividers 140 defining compartments 150.

Figure 2:
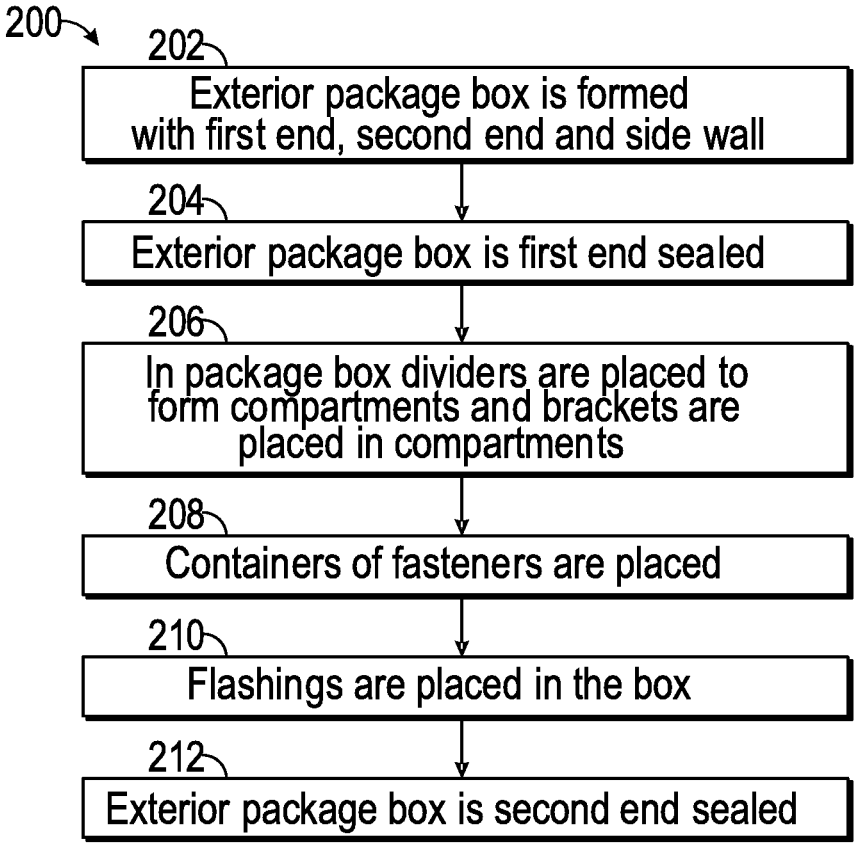
FIG. 2 illustrates a method for packaging solar mounting attachments into the solar mounting attachment package box.

FIG. 2 illustrates a method 200 for packaging a solar mounting attachment. As discussed above, the solar mounting attachment may consist of several components, including a flashing 110, fasteners in the container 120, and an attachment bracket 130. The solar mounting attachment components are to be placed into the package box 100, such that a user may later remove the components from the package box 100 in an efficient sequence or order.

The method begins at step 202, in which the package box 100 is first formed as having the first end 102, the second end 104, and the sidewall 106.

At step 204, the first end 102 of the package box 100 is sealed, so that the components may be placed into the package box 100.

At step 206, the attachment brackets 130 are placed into compartments 150 defined by dividers 140. More specifically, the dividers 140 are disposed adjacent to the first end 102 of the package box 100. Thus, the compartments 150 defined by the dividers 140 are also adjacent to the first end 102, so that the attachment brackets 130 are placed adjacent to the first end 102 of the package box 100. In some embodiments, the dividers 140 are first placed into the package box 100, such that the dividers 140 are disposed in the package box 100 and adjacent to the first end 102.

At step 208, the container 120 of fasteners are placed onto at least one of the attachment brackets 130. The container 120 of fasteners may also be placed onto at least one of the dividers 140. Furthermore, the container 120 of fasteners may be disposed adjacent to at least one portion of the sidewall 106 of the package box 100.

At step 210, the flashings 110 are placed onto at least one of the other attachment brackets 130. Thus, the flashings 110 are placed adjacent to the container 120 of fasteners and at least one other portion of the sidewall 106 of the package box 100.

At step 212, the second end 104 of the package box 100 is sealed, so that the package box 100 may contain and secure all of the components therein.

The result is the package box 100 depicted in FIG. 1A. Thus, the result is the package box 100 having the first end 102, the second end 104, and the sidewall 106. Inside the package box 100, dividers 140 are disposed in the package box 100 defining compartments 150 in the package box 100 and adjacent to the first end 102. Furthermore, the attachment brackets 130 are adjacent to the first end 102 and placed in the compartments 150 defined by the dividers 140. Moreover, the container 120 of fasteners is adjacent to and on top of at least one of the attachment brackets 130 and the dividers 140. Similarly, the flashings 110 are adjacent to the container 120 of fasteners and on top of at least one other attachment bracket 130 and at least one other of the dividers 140.

Therefore, the flashings 110, the container 120 of fasteners, and the attachment brackets 130 may be removed from the package box 100 from the second end 104 in the order of flashings 110, the container 120 of fasteners, and the attachment brackets 130. Since the flashings 110 and the container 120 of fasteners are adjacent to each other and the second end 104, the flashings 110 and the container 120 of fasteners may be removed from the package box in reverse order and/or simultaneously. Thus, the flashings 110, the container 120 of fasteners, and the attachment brackets 130 may also be removed from the package box 100 from the second end 104 in the order of the container 120 of fasteners, flashings 110, and attachment brackets 130.

It is further contemplated that the package box 100 may be packaged or filled in a reverse order. In other words, the package box 100 may be packaged or filled in the order of flashings 110 in the first end 102, the container 120 of fasteners adjacent to the flashings 110 and the first end 102, and the attachment brackets 130 into compartments defined by dividers 140 adjacent to the second end 104. Thus, a user may remove the flashings 110, the container 120 of fasteners, and the attachment brackets 130 from the first end 102 in the order of flashings 110, the container 120 of fasteners, and the attachment brackets 130.

Thus, the method 200 allows for installation of the components of the solar mounting attachments in the same order of removal from the package box 100. In other words, the components of the solar mounting attachments, or the flashings 110, the container 120 of fasteners, and the attachment brackets 130 are then installed in the order of the flashings 110, the container 120 of fasteners, and the attachment brackets 130.

FIGS. 3A-3D illustrate various steps in removing solar mounting attachment components from the package box 100. As discussed above, the first end 102 and the second end 104 may be used interchangeably and are only defined for clarity and discussion purposes. Thus, for the following discussion, the first end 102 is shown to be an upper accessible end of the package box 100, while the second end 104 is shown to be a lower closed end of the package box 100.

Figure 3A:
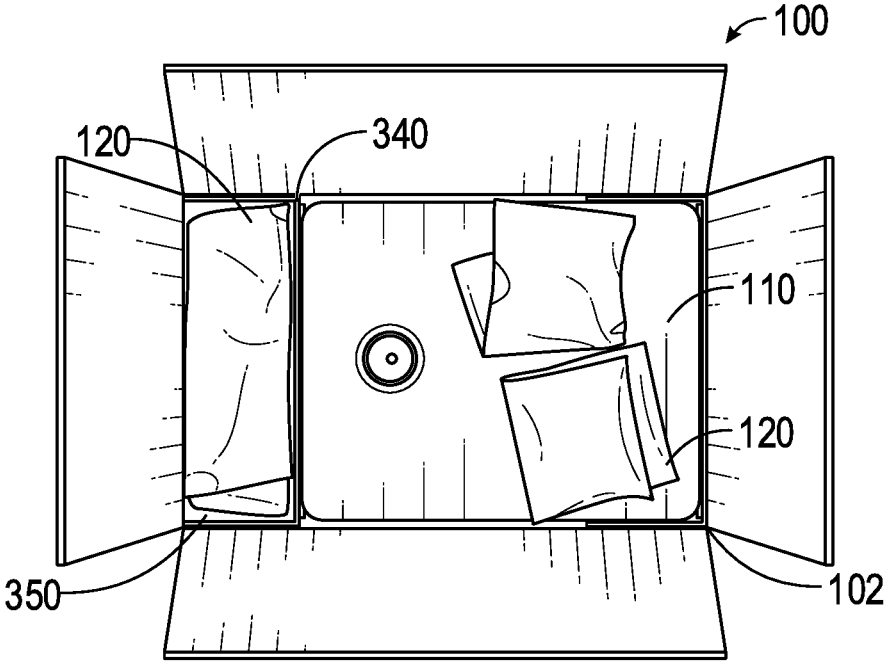
FIG. 3A illustrates the solar mounting attachment package box after opening a first end.

FIG. 3A illustrates the package box 100 after opening the first end 102. From the first end 102, the flashings 110 and the container 120 of fasteners are readily accessible. In some embodiments, the container 120 of fasteners may also be located on the flashings 110, while one or more other containers of fasteners may also be located in a partition 350 defined by the sidewall 106 and a partition wall 340 adjacent to a short side of the flashings 110. In other embodiments of the present invention, multiple containers 120 containing various fastener types may be only placed in the partition 350 along the short side of the flashings. This allows for the container 120 of fasteners to be removed before, after, or simultaneously to the flashings 110 being removed.

Figure 3B:
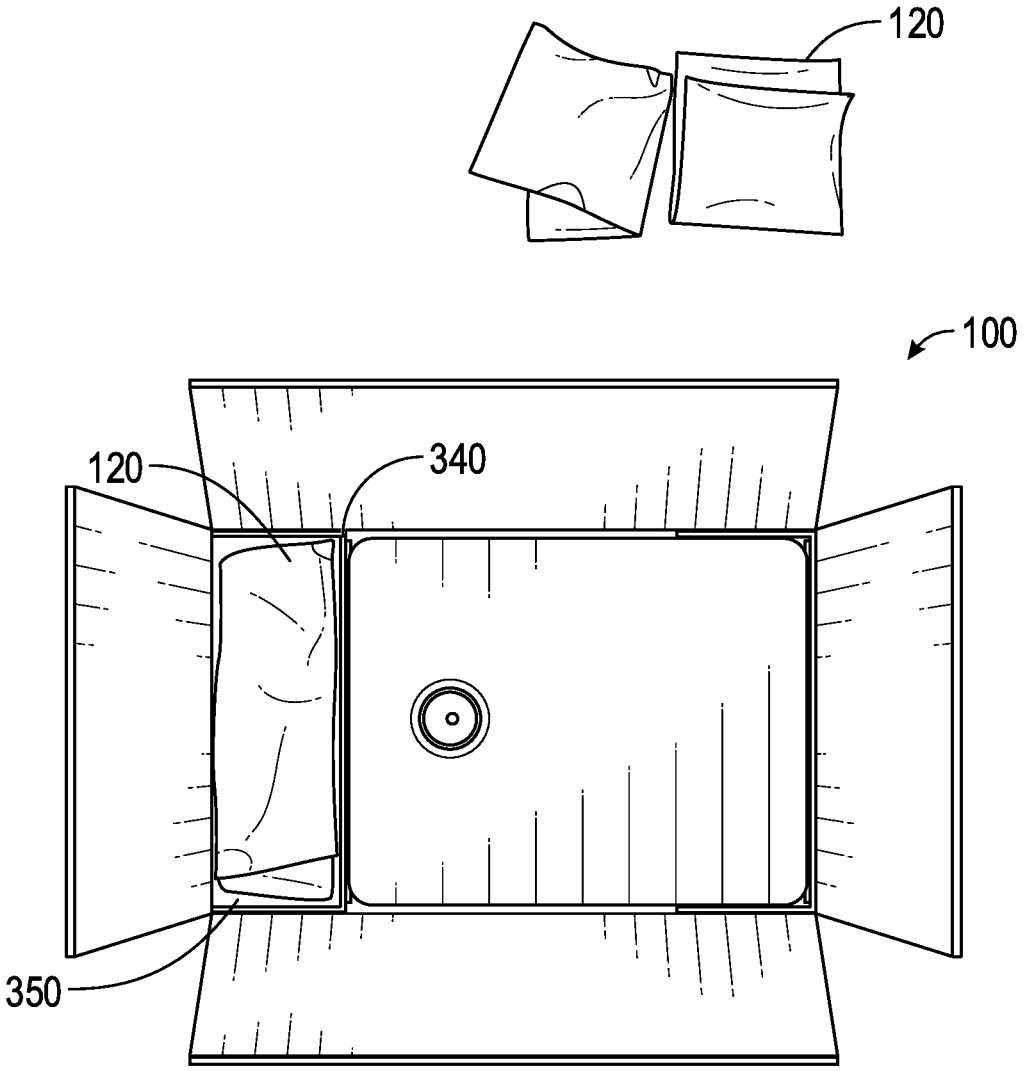
FIG. 3B illustrates the solar mounting attachment package box after removing one or more containers of fasteners.

FIG. 3B illustrates the package box 100 after opening the first end and removing one or more containers 120 of fasteners from the package box 100. These containers 120 can be removed from the box completely, or placed in the partition 350 of the package box 100 with the other containers 120 of fasteners for later use.

Figure 3C:
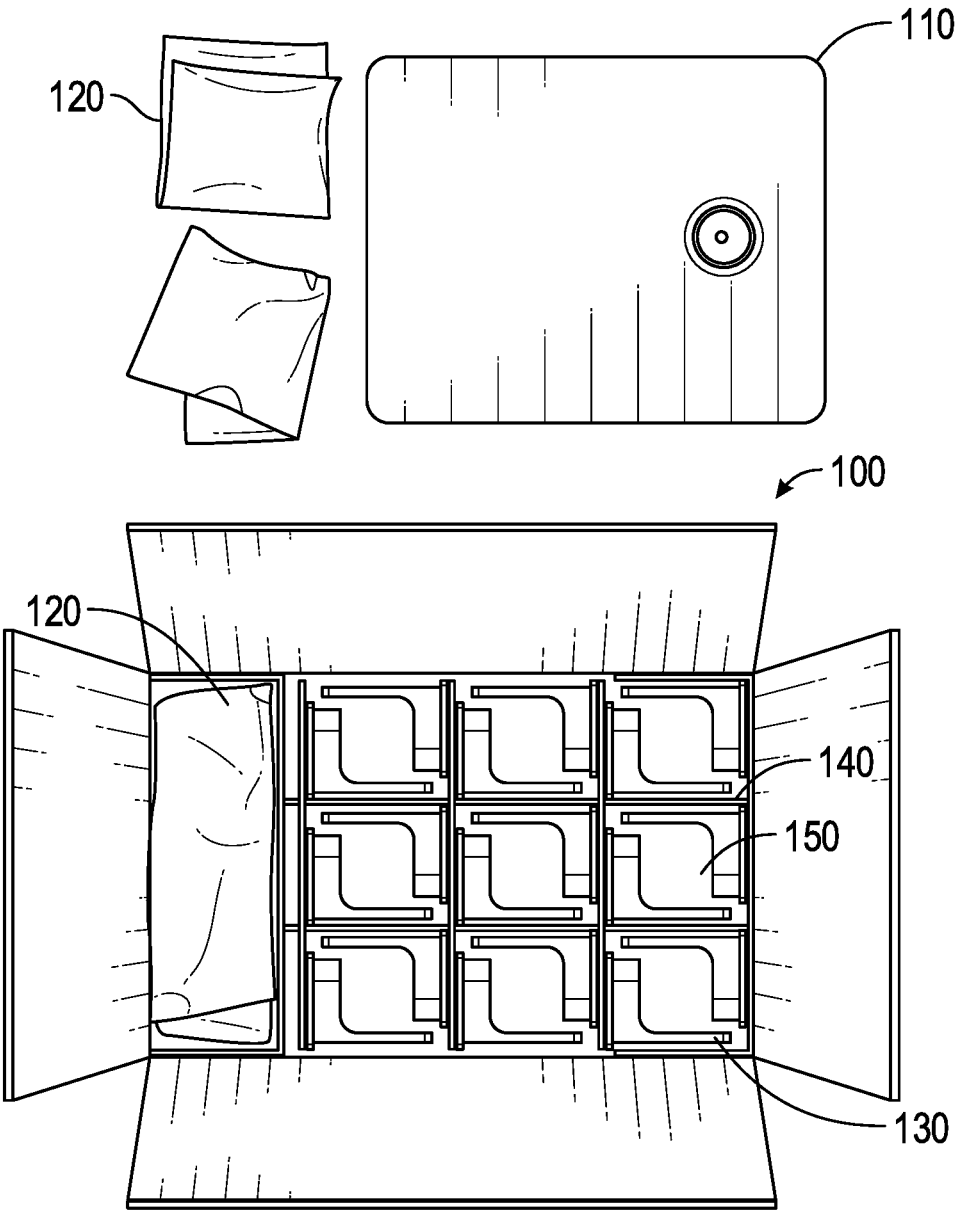
FIG. 3C illustrates the solar mounting attachment package box after removing flashings.

FIG. 3C illustrates the package box 100 after the flashings 110 have been removed. Now, the attachment brackets 130 are readily accessible in the compartments 150 defined by the dividers 140. This allows the flashings 110 to be installed on the roof while the attachment brackets 130 remain in the box. The flashings 110 may be removed one at a time or the entire stack of flashings 110 may be removed in one instance without moving the contents underneath, allowing the containers 120 of fasteners, attachment brackets 130, and dividers 140 to remain within the box.

Figure 3D:
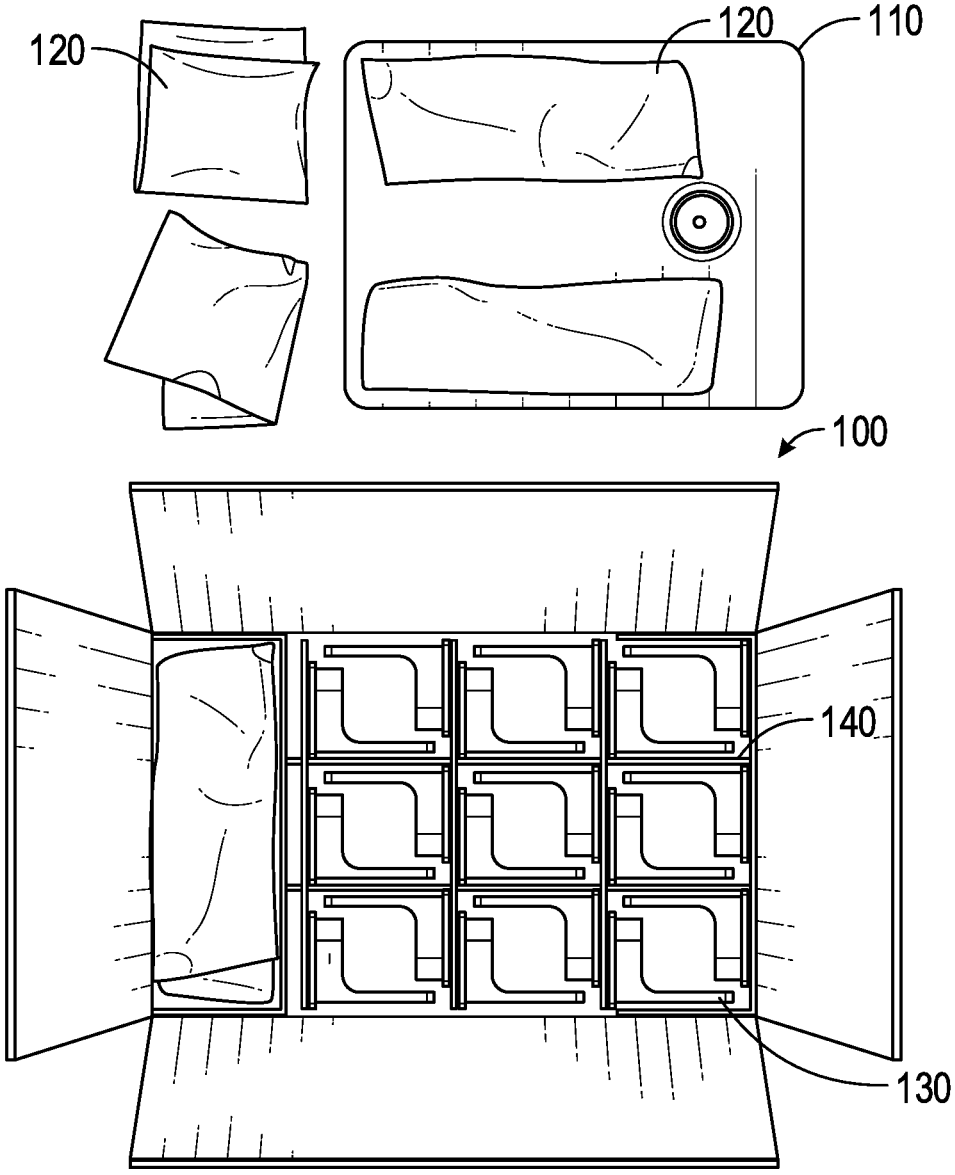
FIG. 3D illustrates a solar mounting attachment package box after removing a container of fasteners.

FIG. 3D illustrates the package box 100 after the flashings 110 and the containers 120 of fasteners have been removed to allow additional access to the attachment brackets 130 on the second end 104 of the package box 100. The containers 120 of fasteners may be removed from the package box 100 without moving the attachment brackets 130 and the dividers 140 underneath, ensuring the attachment brackets 130 and the dividers 140 remain within the package box 100. The exposed attachment brackets 130 may be removed from the box without moving the dividers 140, ensuring the dividers 140 remain within the package box 100. The attachment brackets 130 are the last components that may be installed, thus they are located on the second end 104. This method of unpackaging or removal of components thus follows the order in which the components are installed on the roof surface.

Figure 4:
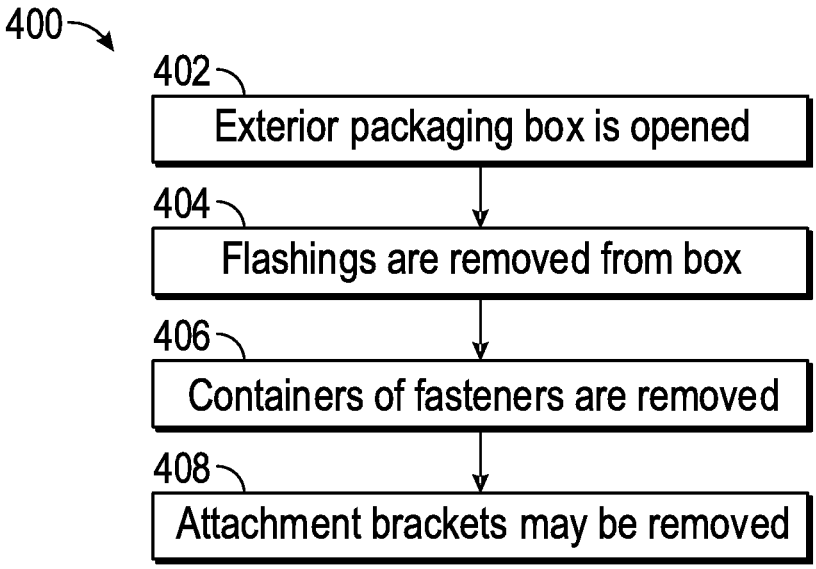
FIG. 4 illustrates an example method for removing a solar mounting attachment from the solar mounting attachment package box.

FIG. 4 is a flow chart depicting an example method 400 for removing solar mounting attachments from the package box 100, as generally described in FIGS. 3A-3D.

The method 400 begins at step 402, in which the first end 102 of the package box 100 is opened.

At step 404, the flashings 110 are removed from the first end 102 of the package box 100.

At step 406, the container 120 of fasteners, which were previously adjacent to the flashings 110, is removed from the first end 102 of the package box 100.

At step 408, the attachment brackets 130 are removed from the compartments 150 defined by the dividers 140. The attachment brackets 130 and compartments 150 were previously adjacent to the flashings 110 and the container 120 of fasteners.

Thus, the flashings 110, the container 120 of fasteners, and the attachment brackets 130 are removed from the box in that order. The flashings 110, the container 120 of fasteners, and the attachment brackets 130 may then be used for installation in the order of at least one of the flashings 110, at least one of the fasteners in the container 120 of fasteners, and at least one of the attachment brackets 130.

Figure 5A:
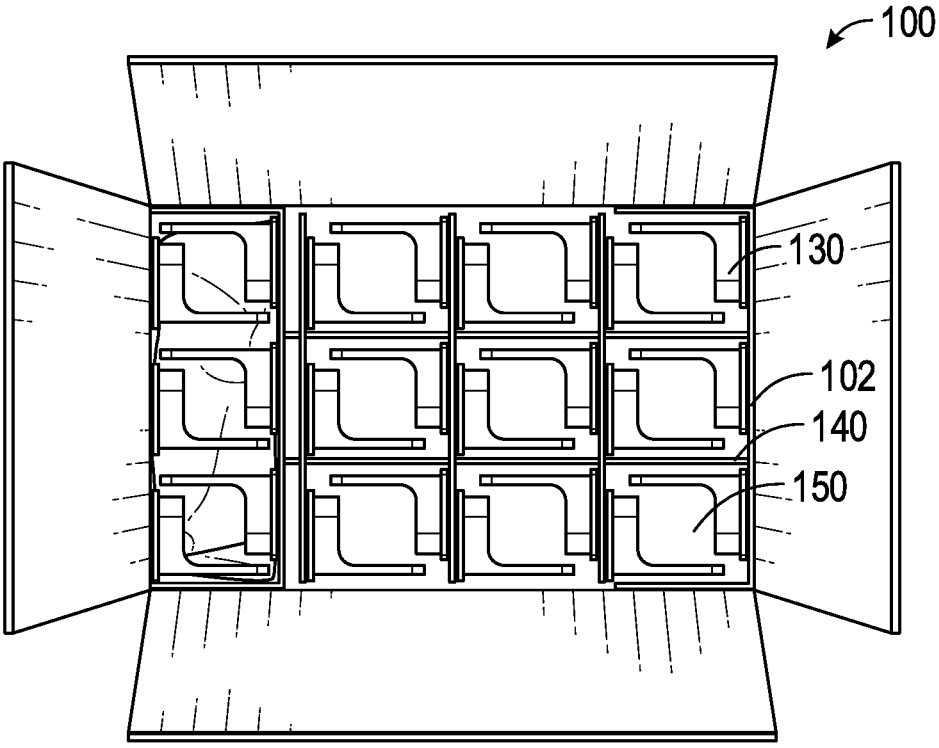
FIG. 5A illustrates a solar mounting attachment package box after opening the first end.
Figure 5B:
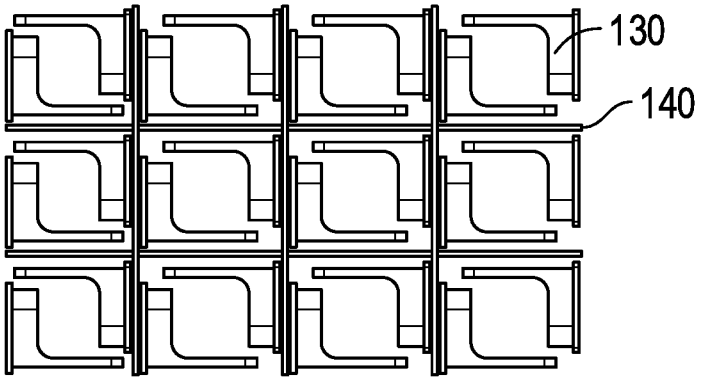
FIG. 5B illustrates the second solar mounting attachment package box after removing the attachment brackets.
Figure 5B:
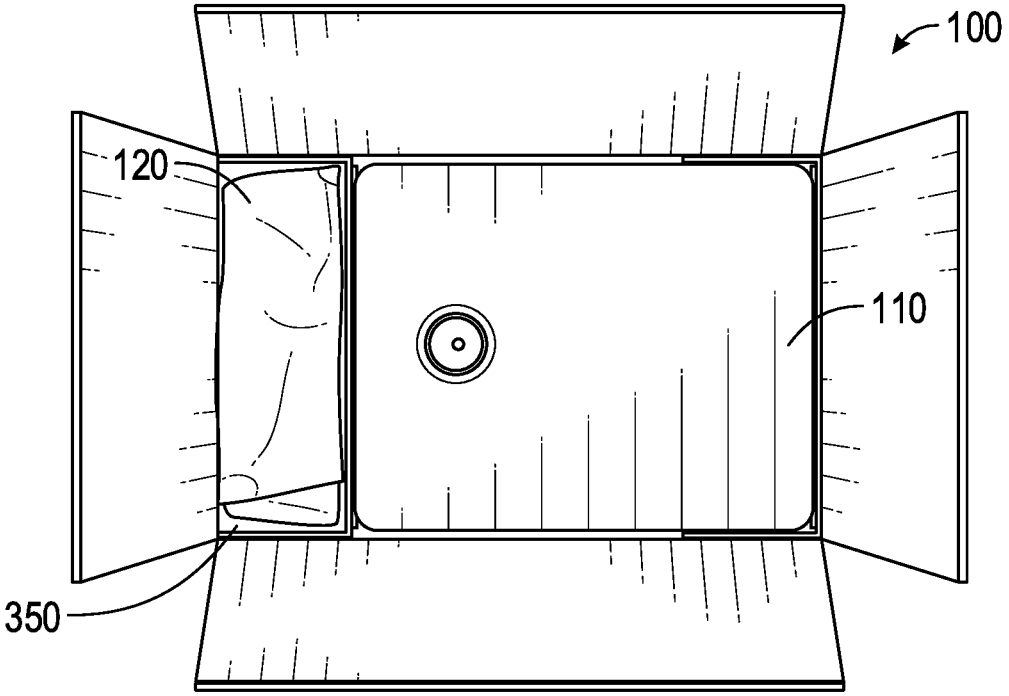
Figure 5C:
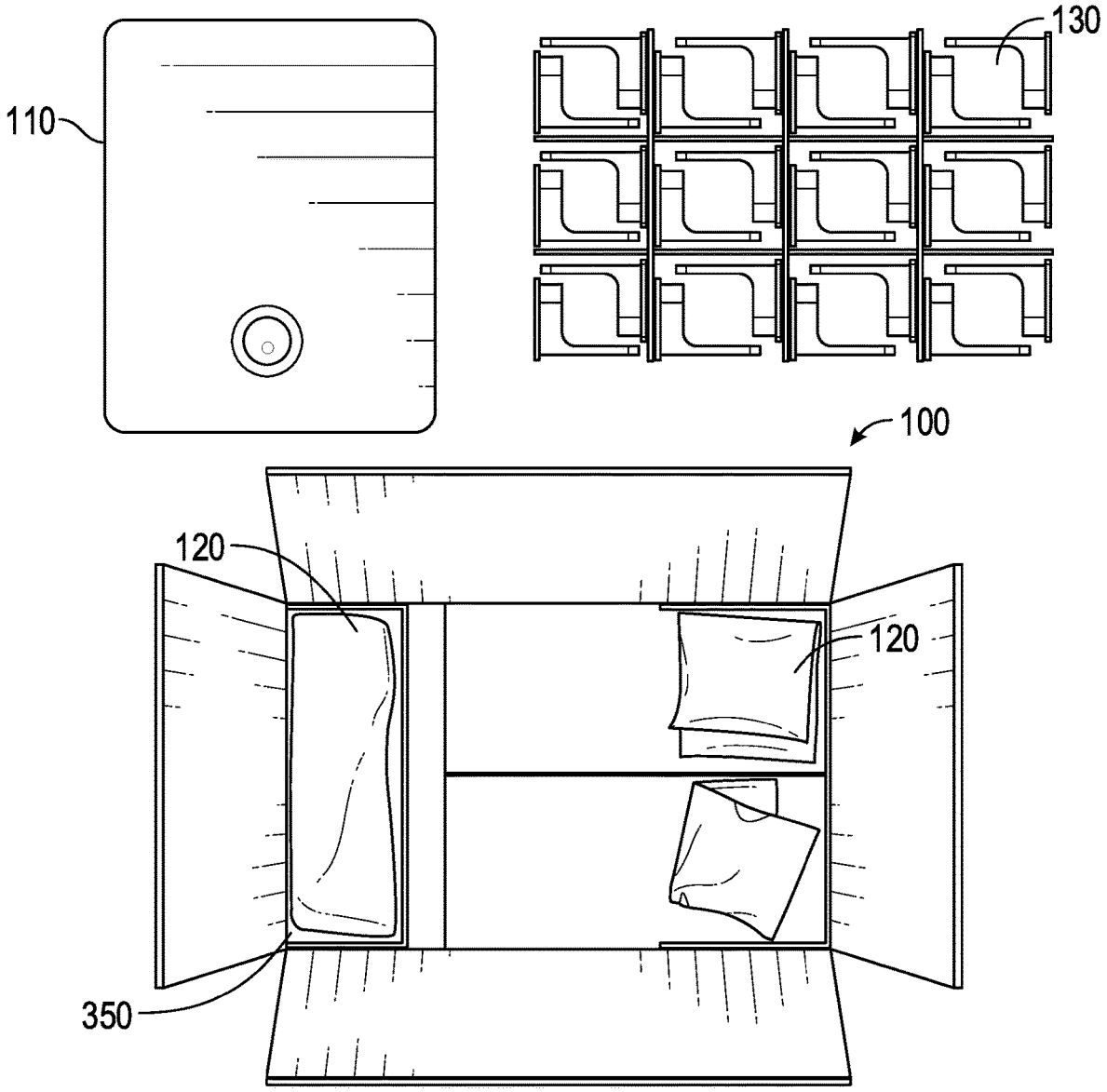
FIG. 5C illustrates the second solar mounting attachment package box after removing the flashings, exposing the containers of fasteners underneath.

FIGS. 5A-5C further contemplate that the components in the package box 100 may be removed in the reverse order by turning the package box 100 upside down, such that the first end 102 is an upper end adjacent to the attachment brackets 130 and the compartments 150 defined by the dividers 140. Accordingly, the second end 104 is a lower end adjacent to the flashings 110 and the container 120 of fasteners. The same is also possible when the package box 100 is packaged in the reverse order or upside down.

FIG. 5A illustrates an alternative configuration of the package box 100 after opening the first end 102. From the first end 102 the attachment brackets 130 are accessible from the compartments 150 defined by the dividers 140. These attachment brackets 130 may be removed from the package box 100 and staged for later use.

FIG. 5B illustrates the package box 100 after the attachment brackets 130 and the dividers 140 are removed. This exposes the flashings 110 and the containers 120 of fasteners underneath. The flashings 110 may be removed individually or as an entire stack without moving any of the components underneath. The containers 120 of fasteners may similarly be accessed without removing the flashings 110, as the containers 120 of fasteners are located in the partition 350 adjacent to the flashings 110.

FIG. 5C depicts the package box 100 once the attachment brackets 130 and flashings 110 have been removed. The one or more fastener containers 120 are still located within the package box 100. The containers 120 may be removed from the package box 100, or the fasteners may be emptied from the containers 120 into the package box 100. The later ensures all small components, such as the fasteners, are located in a confined container, such as the package box 100, for easy access.

Figure 6:
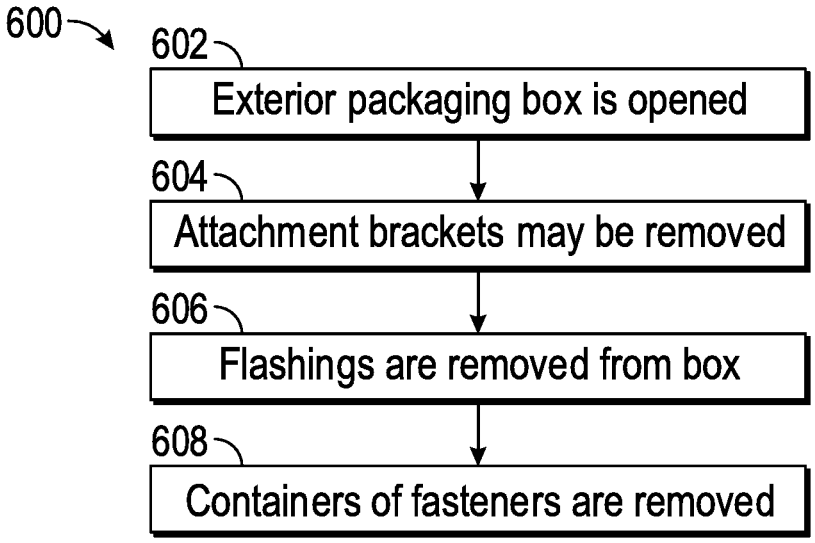
FIG. 6 illustrates another example method to remove a solar mounting attachment from the solar mounting attachment package box.

FIG. 6 is a flow chart depicting an example method 400 for removing solar mounting attachments from the package box 100, as generally described in FIGS. 5A-5C.

The method 600 begins at step 602, in which the first end 102 of the package box 100 is opened.

At step 604, the attachment brackets 130 are removed from the compartments 150 defined by the dividers 140. The attachment brackets 130 and compartments 150 are adjacent to the flashings 110 and the container 120 of fasteners.

At step 606, the flashings 110 adjacent to the container of fasteners are removed from the first end 102 of the package box 100.

At step 608, the container 120 of fasteners disposed on the second end 104 of the package box 100 is removed from the first end 102 of the package box 100.

Thus, the attachment brackets 130, the container 120 of fasteners, and the flashings 110 are removed from the package box 100 in that order. The flashings 110, the container 120 of fasteners, and the attachment brackets 130 may then be used for installation in the order of at least one of the flashings 110, at least one of the fasteners in the container 120 of fasteners, and at least one of the attachment brackets 130.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

What is claimed is:

1. A package box comprising:

a first end and a second end;

a plurality of dividers disposed in the package box and adjacent to the first end, the dividers defining compartments in the package box;

attachment brackets placed in the compartments defined by at least one of the dividers;

a container of fasteners adjacent to and on top of at least one of the attachment brackets that are placed in the compartments defined by at least one of the dividers; and flashings adjacent to the container of fasteners and on top of at least one other of the attachment brackets and on top of at least one other of the dividers, wherein the flashings, the container of fasteners, and attachment brackets may be removed from the package box from the second end in an order of flashings, the container of fasteners, and attachment brackets.

2. The package box of claim 1, wherein the container of fasteners and the flashings may also be removed simultaneously.

3. A package box comprising:

a first end and a second end;

attachment brackets placed adjacent to the first end;

a container of fasteners adjacent to and on top of at least one of the attachment brackets;

flashings adjacent to the container of fasteners and on top of at least one other of the attachment brackets;

wherein the flashings, the container of fasteners, and attachment brackets may be removed from the package box from the second end in an order of flashings, the container of fasteners, and attachment brackets, wherein the flashings, the container of fasteners, and attachment brackets may also be removed from the package box from the second end in the order of the container of fasteners, flashings, and attachment brackets.

* * * * *